US011581670B2

(12) United States Patent
Cheng et al.

(10) Patent No.: US 11,581,670 B2
(45) Date of Patent: Feb. 14, 2023

(54) ELECTRICAL CONNECTOR AND ELECTRICAL CONNECTOR ASSEMBLY

(71) Applicant: Dongguan Luxshare Technologies Co., Ltd, Dongguan (CN)

(72) Inventors: HengShan Cheng, Dongguan (CN); HongJi Chen, Dongguan (CN); YiHeng Lin, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/463,861

(22) Filed: Sep. 1, 2021

(65) Prior Publication Data

US 2022/0094086 A1 Mar. 24, 2022

(30) Foreign Application Priority Data

Sep. 23, 2020 (CN) ..... 202011011148.7

(51) Int. Cl.
*H01R 12/70* (2011.01)
*H01R 12/72* (2011.01)
(Continued)

(52) U.S. Cl.
CPC ..... *H01R 12/7011* (2013.01); *H01R 12/722* (2013.01); *H01R 12/732* (2013.01); *H01R 13/6275* (2013.01); *H01R 12/721* (2013.01)

(58) Field of Classification Search
CPC ..... H01R 12/7011; H01R 12/722; H01R 12/721; H01R 12/7082; H01R 12/727;
(Continued)

(56) References Cited

U.S. PATENT DOCUMENTS 5,228,870 A * 7/1993 Gorenc ..... H01R 12/7064 439/571
5,575,663 A * 11/1996 Broschard, III ... H01R 12/7023 439/79
(Continued)

FOREIGN PATENT DOCUMENTS

CN 209860183 U 12/2019
CN 111244686 A * 6/2020 ..... H01R 12/7082
(Continued)

*Primary Examiner* — Travis S Chambers
(74) *Attorney, Agent, or Firm* — Birch, Stewart, Kolasch & Birch, LLP

(57) ABSTRACT

An electrical connector and electrical connector assembly. The electrical connector comprises a connector and a securing member. The connector comprises a body and a connecting terminal port. The connecting terminal port is disposed at one side of the body. The securing member comprises a securing part and a clamping part. The securing part is assembled on the body and is disposed at one side of the connecting terminal port. The clamping direction of the clamping part is identical to the opening direction of the connecting terminal port. The circuit board is connected to the connecting terminal port, and the clamping part of the securing member is used to clamp and secure the circuit board. The securing member can be assembled according to the shape and structural configuration of the body of the connector through a component of the securing member corresponding to one side of the body of the connector.

15 Claims, 11 Drawing Sheets

(51) Int. Cl.
*H01R 12/73* (2011.01)
*H01R 13/627* (2006.01)

(58) Field of Classification Search
CPC ..... H01R 12/732; H01R 13/629; H01R 13/6597; H01R 12/7029; H01R 13/40; H01R 13/502; H01R 13/6275; H10R 12/73
See application file for complete search history.

(56) References Cited

U.S. PATENT DOCUMENTS

| | | | | |
|---|---|---|---|---|
| 5,893,764 | A * | 4/1999 | Long | H01R 12/7029 439/570 |
| 6,341,988 | B1 * | 1/2002 | Zhu | H01R 12/721 439/79 |
| 6,767,235 | B2 * | 7/2004 | Wu | H01R 12/7058 439/328 |
| 7,112,072 | B2 * | 9/2006 | Korsunsky | H01R 13/652 439/108 |
| 8,123,534 | B1 * | 2/2012 | Herring | H01R 12/721 439/328 |
| 2002/0004337 | A1 * | 1/2002 | Chiang | H01R 12/721 439/607.01 |
| 2005/0026473 | A1 | 2/2005 | Shiu | |
| 2020/0274269 | A1 * | 8/2020 | Teh | G06F 1/183 |

FOREIGN PATENT DOCUMENTS

| | | | | |
|---|---|---|---|---|
| TW | 570367 | U | 1/2004 | |
| WO | WO-2017189363 | A1 * | 11/2017 | H01R 12/7029 |

* cited by examiner

ELECTRICAL CONNECTOR AND ELECTRICAL CONNECTOR ASSEMBLY

CROSS-REFERENCE TO RELATED APPLICATION

This application claims the priority benefit of Chinese Patent Application Serial Number 202011011148.7, filed on Sep. 23, 2020, the full disclosure of which is incorporated herein by reference.

BACKGROUND

Technical Field

The present disclosure relates to the technical field of connector, particularly to an electrical connector and an electrical connector assembly.

Related Art

Conventional Gen Z connectors can be applied to perform circuit board-to-circuit board connection and circuit line-to-circuit board connection. The circuit board-to-circuit board connections are vertical connection, right angle connection, straddle mount connection and orthogonal connection. In the straddle mount connection, two sides of the electrical connector are provided with securing lugs for securing the circuit board. When the connector is electrically connected to the circuit board, the securing lugs of the connector corresponds to the circuit board, and one end of a screw is threaded through the securing lug to be secured onto the circuit board. Thus, the connector can be secured onto the circuit board. Since the securing lug of conventional electrical connectors is designed in a size that is quite space-occupying, they would highly affect the follow-up modifications in circuit board design and assembly.

SUMMARY

The embodiments of the present disclosure provide an electrical connector and an electrical connector assembly tended to solve the problem that the size of the securing lug of the conventional electrical connector is oversized and space-occupying, which affects the circuit board design and assembly.

On the first aspect, the present disclosure provides an electrical connector comprising a connector and a securing member. The connector comprises a body and a connecting terminal port. The connecting terminal port is disposed at one side of the body. The securing member comprises a securing part and a clamping part. The securing part is assembled on the body and is disposed at one side of the connecting terminal port. The clamping direction of the clamping part is the same as the opening direction of the connecting terminal port.

On the second aspect, the present disclosure provides an electrical connector assembly comprising an electrical connector according to the first aspect and a mating circuit board. The electrical connector further comprises a connecting port disposed at one side of the body away from the connecting terminal port. The mating circuit board is plugged in the connecting port.

In the embodiments of the present disclosure, the securing member can be assembled according to the shape and structural configuration of the body through a component of the securing member corresponding to one side of the body of the connector to minimize the space that the securing member occupies thereby to reduce the overall size of the electrical connector.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
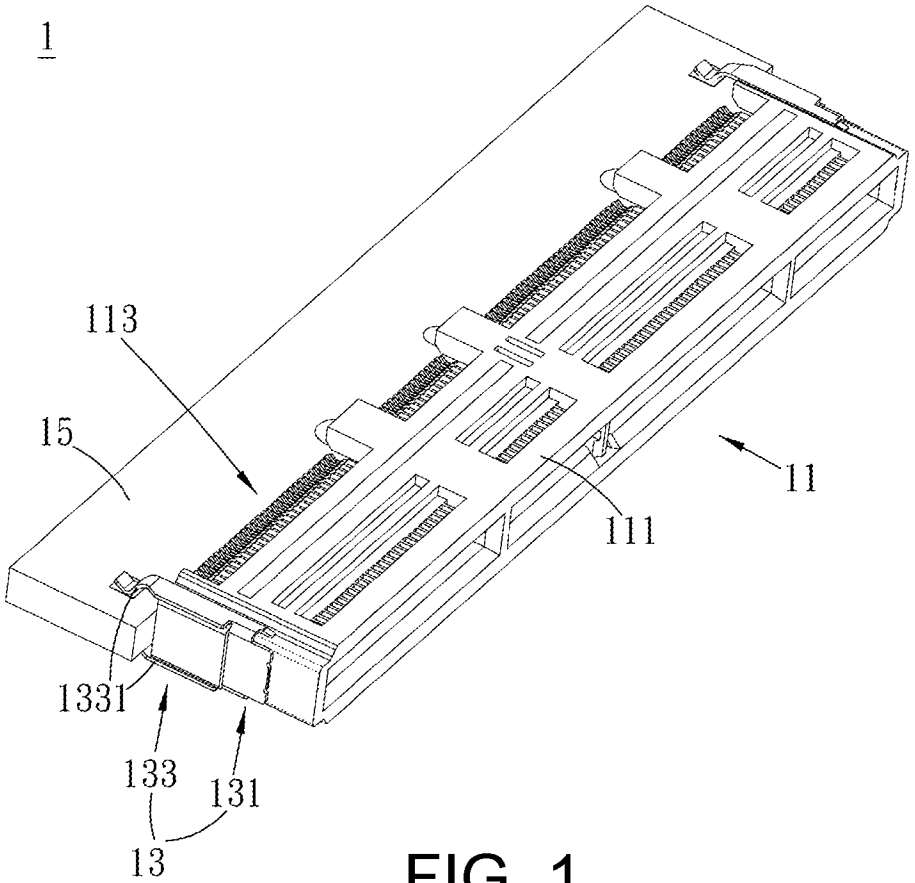
FIG. 1 is a perspective view of an electrical connector of the present disclosure.

FIG. 1 is a perspective view of an electrical connector of the present disclosure. As shown in the figure, in this embodiment, an electrical connector 1 is provided, comprising a connector 11 and a securing member 13. The connector 11 comprises a body 111 and a connecting terminal port 113. The connecting terminal port 113 is disposed at one side of the body 111. The securing member 13 comprises a securing part 131 and a clamping part 133. The securing part 131 is assembled on the body 111 and is disposed at one side of the connecting terminal port 113. The clamping direction of the clamping part 133 is the same as the opening direction of the connecting terminal port 113. In this embodiment, the electrical connector 1 could be used for high-speed transmission and could be used in the Gen Z connector.

In this embodiment, the number of the securing parts 13 is two. The two securing parts 13 are assembled on the body 111 and are disposed at two sides of the connecting terminal port 113. The electrical connector 1 further comprises a circuit board 15 which is electrically connected with the connecting terminal port 113. The clamping parts 133 of the two securing members 13 clamps and secures the circuit board 15. Two clamping feet 1331 of the clamping part 133 abut against and are secured on an upper surface and a lower surface respectively. In this embodiment, the securing member 13 can be assembled according to the shape and structural configuration of the body 111 of the connector 11 through a component of the securing part 131 of the securing member 13 corresponding to two sides of the body 111 of the connector 11 to minimize the space that the securing member 13 occupies thereby to reduce the overall size of the electrical connector 1, which improves the structural designing and assembly process of the electrical connector 1.

The securing part 131 of the securing member 13 is attached to a side surface of the body 111 of the connector 11, and an upper side edge and a lower side edge of the securing part 131 extend in a direction toward an upper surface and a lower surface of the body 111. So that the securing part 131 could cover the side surface, the upper surface, and the lower surface of the body 111. The clamping part 133 of the securing member 13 comprises two clamping feet 1331 oppositely disposed. The two clamping feet 1331 of the clamping part 133 extend toward the opening of the connecting terminal port 113 from the upper side edge and the lower side edge of the securing part 131 respectively. The two clamping feet 1331 extendingly correspond to the upper and lower sides of the connecting terminal port, respectively.

Figure 4:
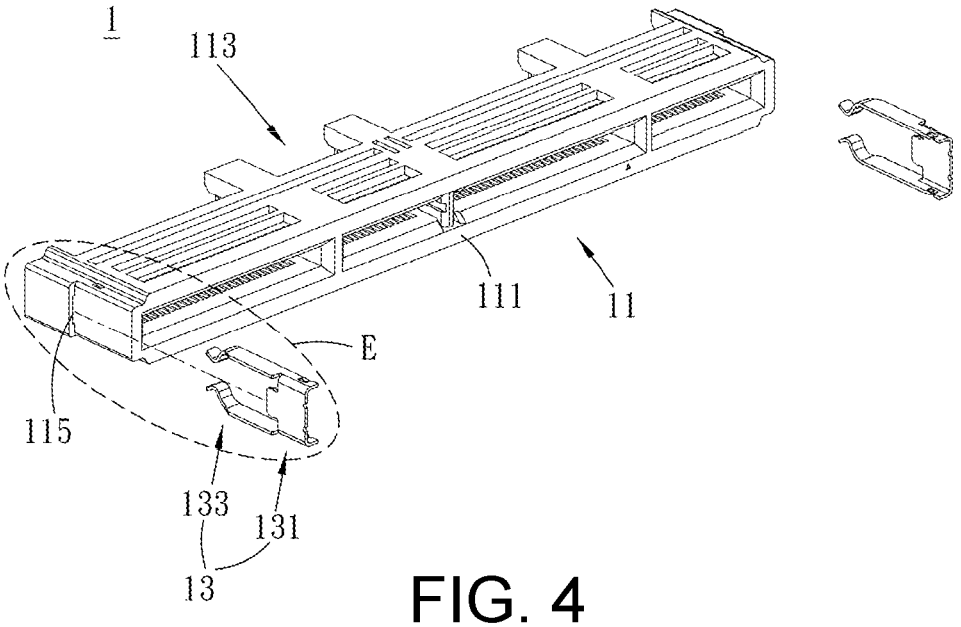
FIG. 4 is an exploded view of the electrical connector of the first embodiment of the present disclosure.
Figure 5:
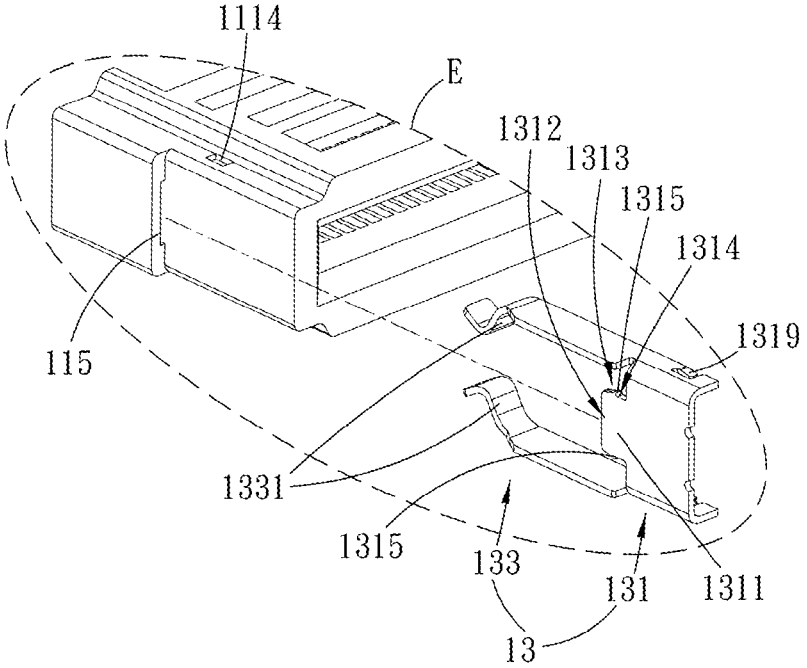
FIG. 5 is an enlarged view of area E of FIG. 4.

FIG. 5 is an enlarged view of area E of FIG. 4. In this embodiment, the securing part 131 further comprises two stopping bumps 1319 respectively extending in a direction away from one side comprising the connecting terminal port 113 from the upper side edge and the lower side edge of the securing part 131. The two stopping bumps 1319 are disposed above and below the securing part 131, respectively. The connector 11 further comprises two stopping recesses 1114 disposed on an upper surface and a lower surface at one side of the body, respectively. The two stopping bumps 1319 are embedded in the two stopping recesses 1114. In this way, the securing member 13 can be kept from being detached from the body 111 of the connector 11, to strengthen the securing of the securing member 13 at one side of the body 111.

Figure 2:
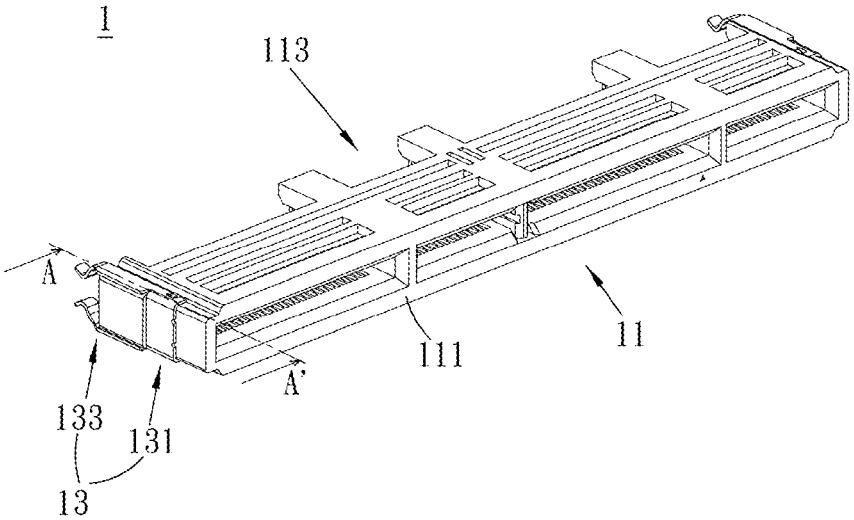
FIG. 2 is a perspective view of an electrical connector of the first embodiment of the present disclosure.
Figure 3:
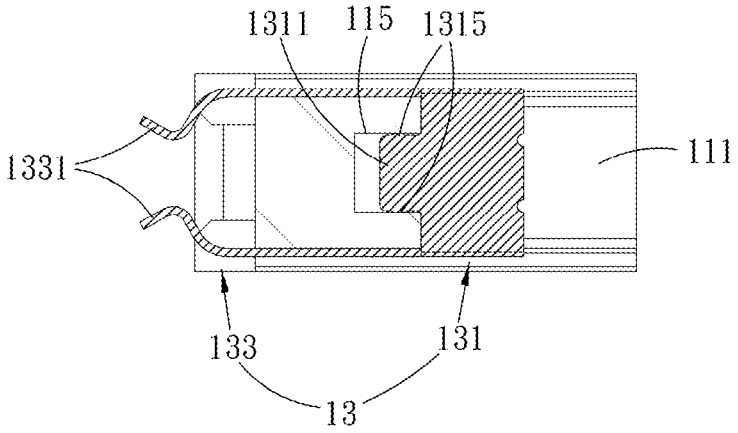
FIG. 3 is an enlarged cross-sectional view along line A-A' of FIG. 2.

FIG. 2 is a perspective view of an electrical connector of the first embodiment of the present disclosure. FIG. 3 is an enlarged cross-sectional view along line A-A' of FIG. 2. FIG. 4 is an exploded view of the electrical connector of the first embodiment of the present disclosure. Referring to FIG. 2 to FIG. 5, in this embodiment, the securing part 131 of the securing member 13 comprises a securing bump 1311. A side surface of the body 11 comprises a securing groove 15. The securing bump 1311 is embedded in the securing groove 115. The securing bump 1311 comprises an outer surface 1312, an inner surface 1313, and two side surfaces 1314. The inner surface 1313 is close to the connector 11. The outer surface 1312 is opposite to the inner surface 1313. The two side surfaces 1314 are connected with the outer surface 1312 and the inner surface 1313. The two side surfaces 1314 of the securing bump 1311 respectively comprises an abutting block 1315. The abutting block 1315 increases the distance between the two side surfaces 1314 of the securing bump 1311. In this way, the securing bump 1311 is secured by being supported by the protruding abutting block 1315 to abut against two groove inner sidewalls in the securing groove 115.

Besides, in this embodiment, the securing member 13 can be disassembled from the connector 11. By pulling the securing member 13 away from the connector 11 with the pulling force greater than the friction force of the abutting block 1315 against the securing groove 115, the securing member 13 can be disassembled from the securing groove 115.

Figure 6:
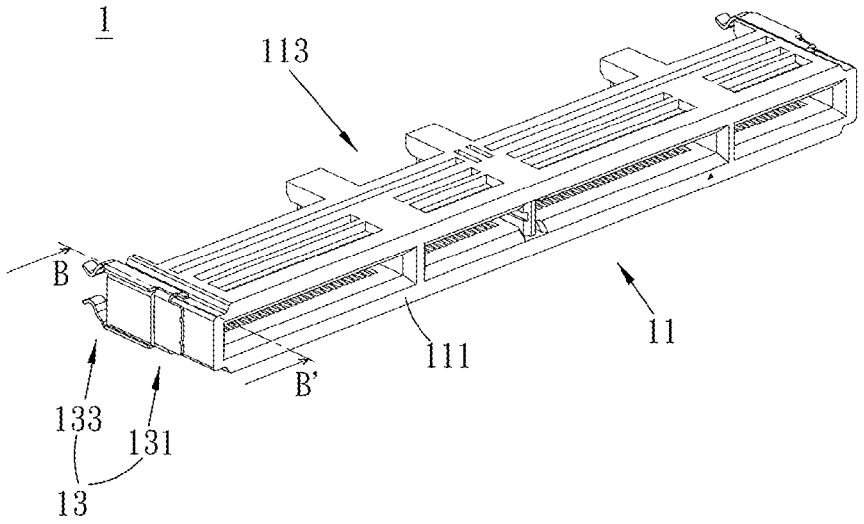
FIG. 6 is a perspective view of an electrical connector of the second embodiment of the present disclosure.
Figure 7:
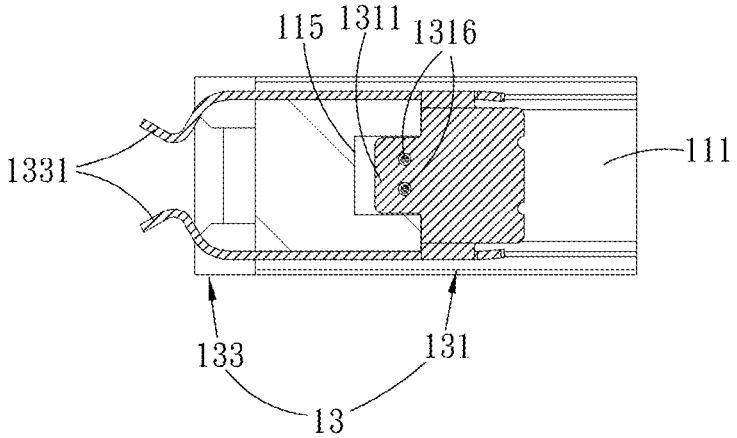
FIG. 7 is an enlarged cross-sectional view along line B-B' of FIG. 6.
Figure 8:
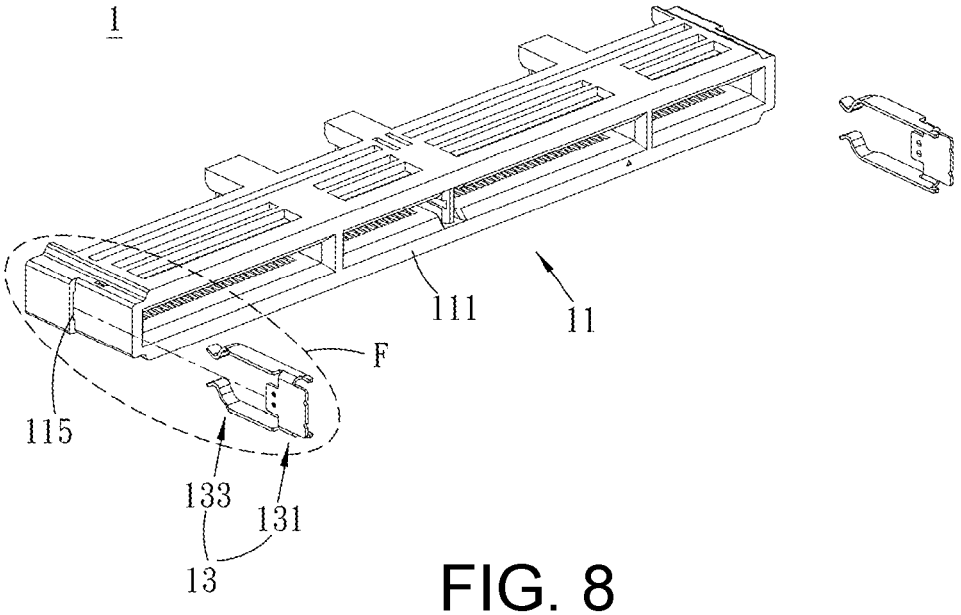
FIG. 8 is an exploded view of the electrical connector of the second embodiment of the present disclosure.
Figure 9:
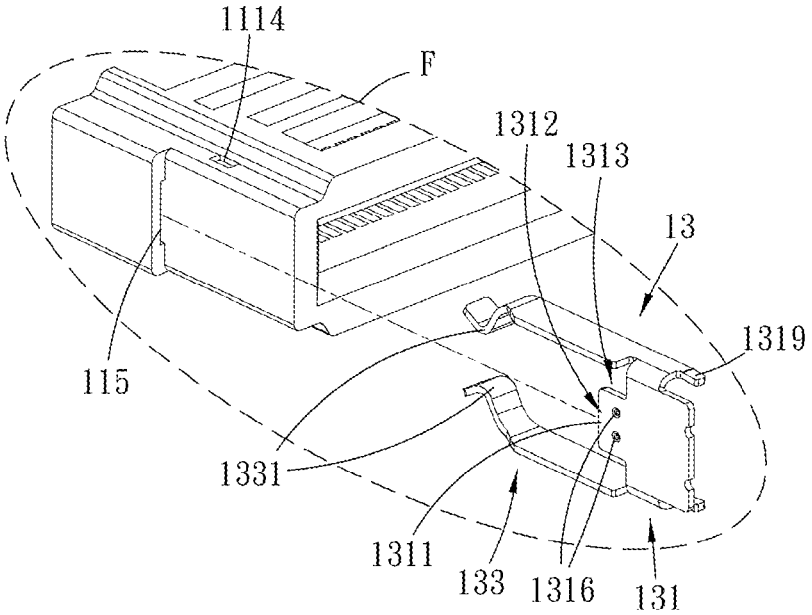
FIG. 9 is an enlarged view of area F of FIG. 8.

FIG. 6 is a perspective view of an electrical connector of the second embodiment of the present disclosure. FIG. 7 is an enlarged cross-sectional view along line B-B' of FIG. 6. FIG. 8 is an exploded view of the electrical connector of the second embodiment of the present disclosure. FIG. 9 is an enlarged view of area F of FIG. 8. As shown in the figures, the difference between this embodiment and the first embodiment lies in the configuration of the securing member 13 and the way the securing member 13 connected to the securing groove 115. In this embodiment, the outer surface 1312 or the inner surface 1313 of the securing bump 1311 comprises a bump 1316 abutting against the inner wall of the securing groove 115. The bump 1316 is a semicircular convex to increases the thickness in a direction from the inner surface 1313 to the outer surface 1312. In this way, the securing bump 1311 is secured by being supported by the bump 1316 to abut against the inner wall of the securing groove 115.

Besides, in this embodiment, same as the first embodiment, the securing member 13 can be disassembled from the connector 11. By pulling the securing member 13 away from the connector 11 with the pulling force greater than the friction force of the bump 1316 against the securing groove 115, the securing member 13 can be disassembled from the securing groove 115.

Figure 10:
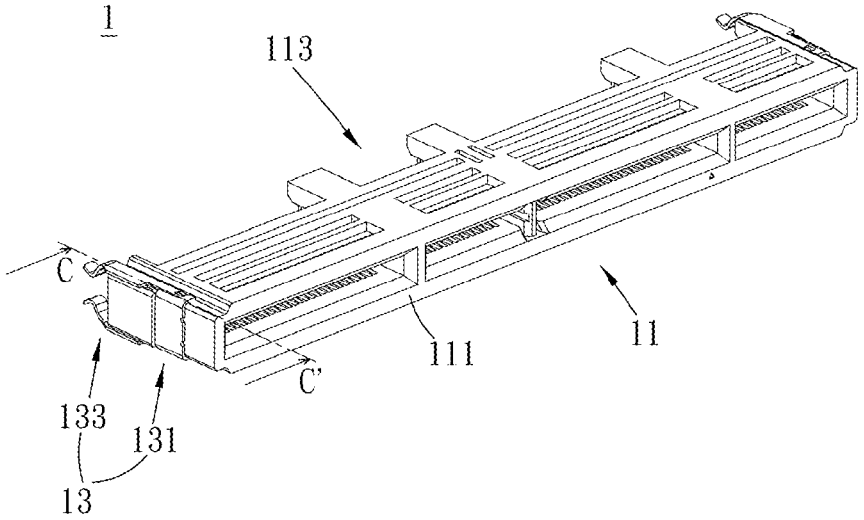
FIG. 10 is a perspective view of an electrical connector of the third embodiment of the present disclosure.
Figure 11:
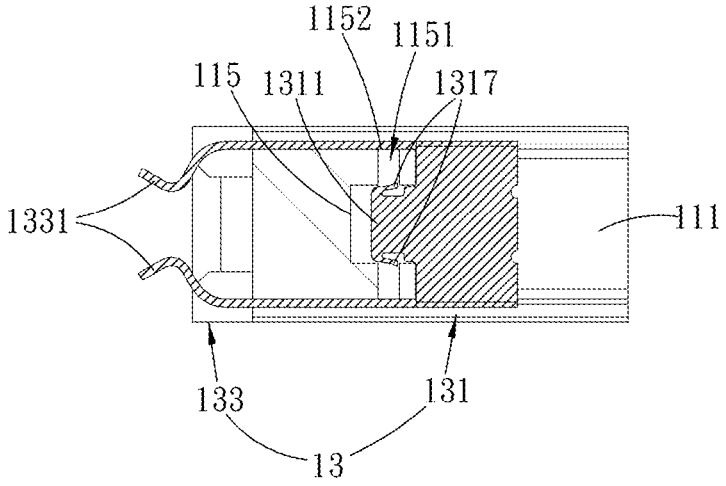
FIG. 11 is an enlarged cross-sectional view along line C-C' of FIG. 10.
Figure 12:
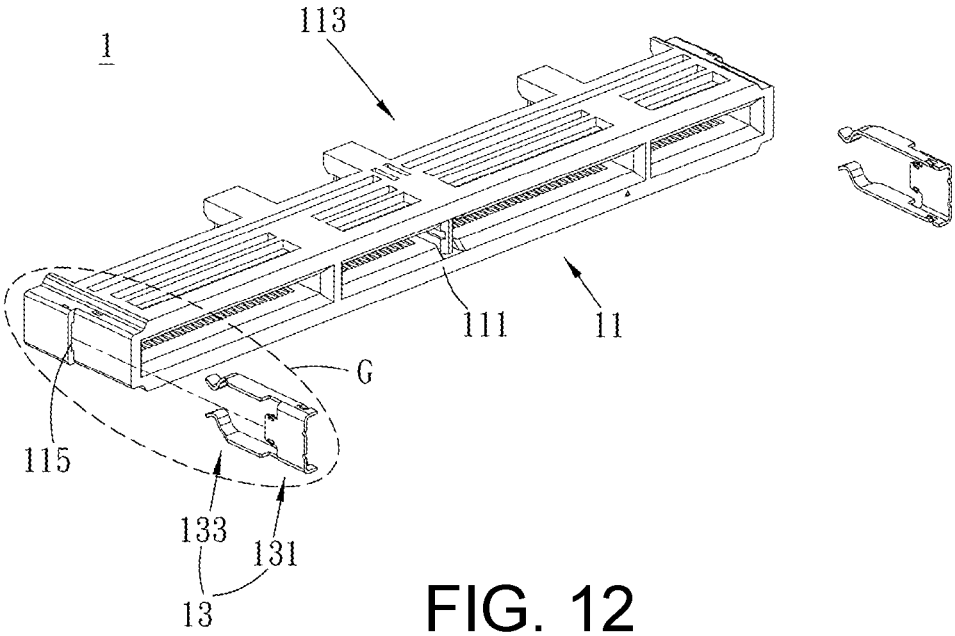
FIG. 12 is an exploded view of the electrical connector of the third embodiment of the present disclosure.
Figure 13:
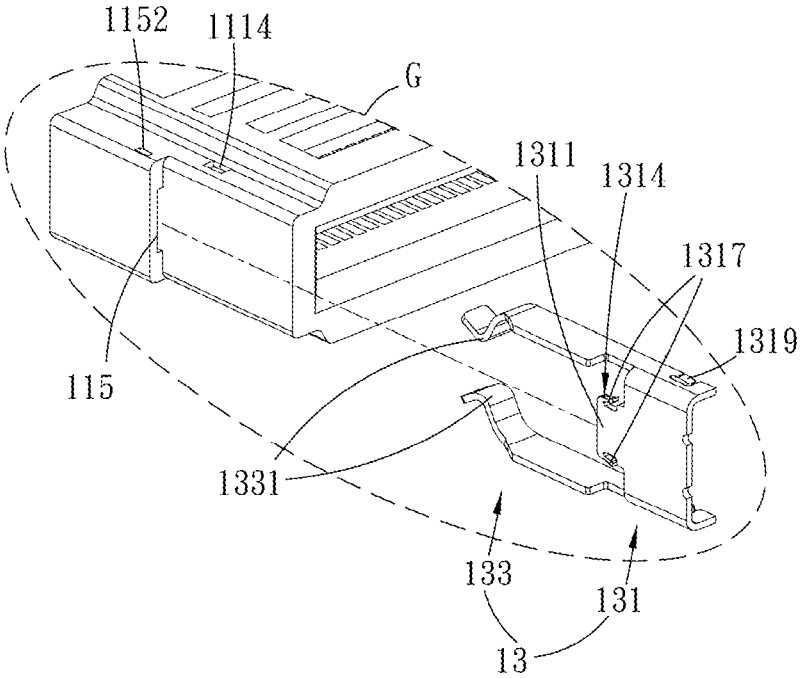
FIG. 13 is an enlarged view of area G of FIG. 12.

FIG. 10 is a perspective view of an electrical connector of the third embodiment of the present disclosure. FIG. 11 is an enlarged cross-sectional view along line C-C' of FIG. 10. FIG. 12 is an exploded view of the electrical connector of the third embodiment of the present disclosure. FIG. 13 is an enlarged view of area G of FIG. 12. As shown in the figures, the difference between this embodiment and the first embodiment lies in the configuration of the securing member 13 and the way the securing member 13 connected to the securing groove 115. In this embodiment, the two side surfaces 1314 of the securing bump 1311 respectively comprises an elastic member 1317. A through hole 1151 provided in the securing groove 115 corresponds to the elastic member 1317. The elastic member 1317 is secured in the through hole 1151.

In this embodiment, when the securing bump 1311 enters the securing groove 115, the elastic member 1317 of the securing bump 1311 would be compressed by the inner sidewall of the securing groove 115 to be in a compressed state. Then the securing bump 1311 moves into the securing groove 115. When the elastic member 1317 of the securing bump 1311 moves to the through hole 1151 in the securing groove 115, the elastic member 1317 would be no longer compressed by the inner wall of the groove, then the elastic member 1317 is restored to the initial state as it is secured in the through hole 1151 of the securing groove 115. Finally, the securing bump 1311 is secured in the securing groove 115.

Besides, in this embodiment, the fixing member 13 can also be disassembled and detached from the connector 11. The through hole 1151 penetrates the securing groove 115. An orifice 1152 of the through hole 1151 is provided on the outside of the securing groove 115. That is, the orifice 1152 is connected to the inside of the securing groove 115. The orifice 1152 of the through hole 1151 at the outside of the securing groove 115 compresses the elastic member 1317. When the elastic member 1317 is compressed, it would no longer be secured in the through hole 1151 to be released from being secured in the through hole 1151. Thus, the securing bump 1311 of the securing member 13 can be detached from the securing groove 115.

Figure 14:
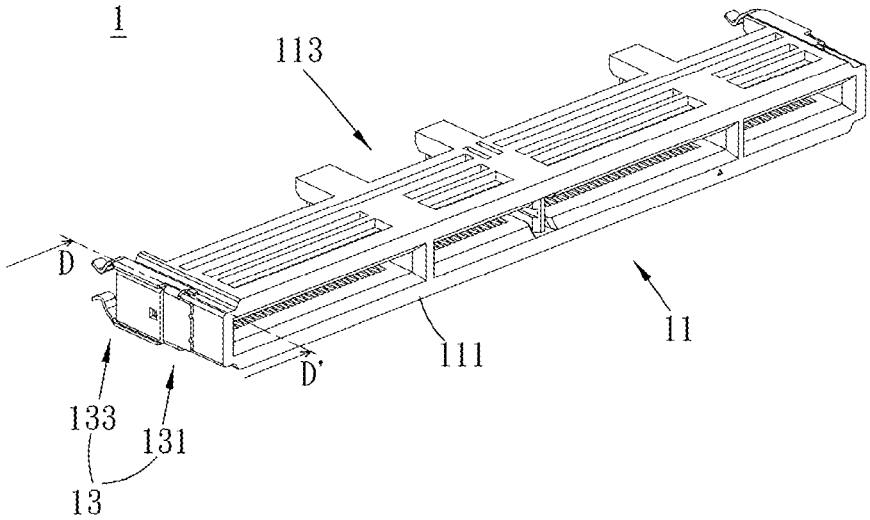
FIG. 14 is a perspective view of an electrical connector of the fourth embodiment of the present disclosure.
Figure 15:
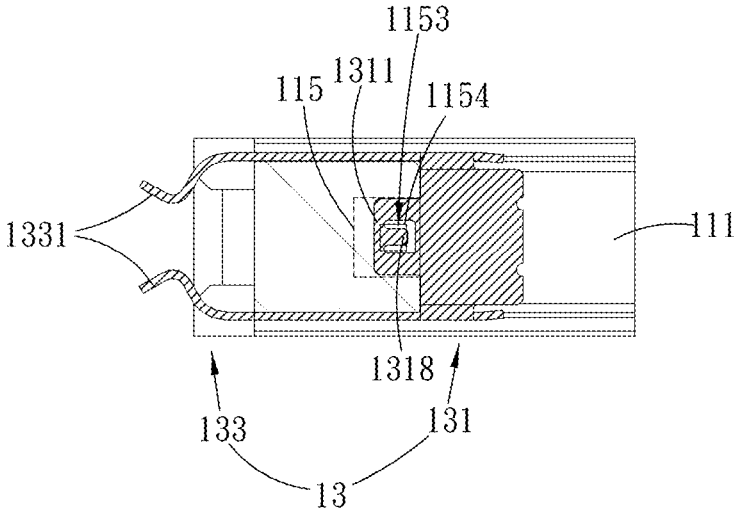
FIG. 15 is an enlarged cross-sectional view along line D-D' of FIG. 14.
Figure 16:
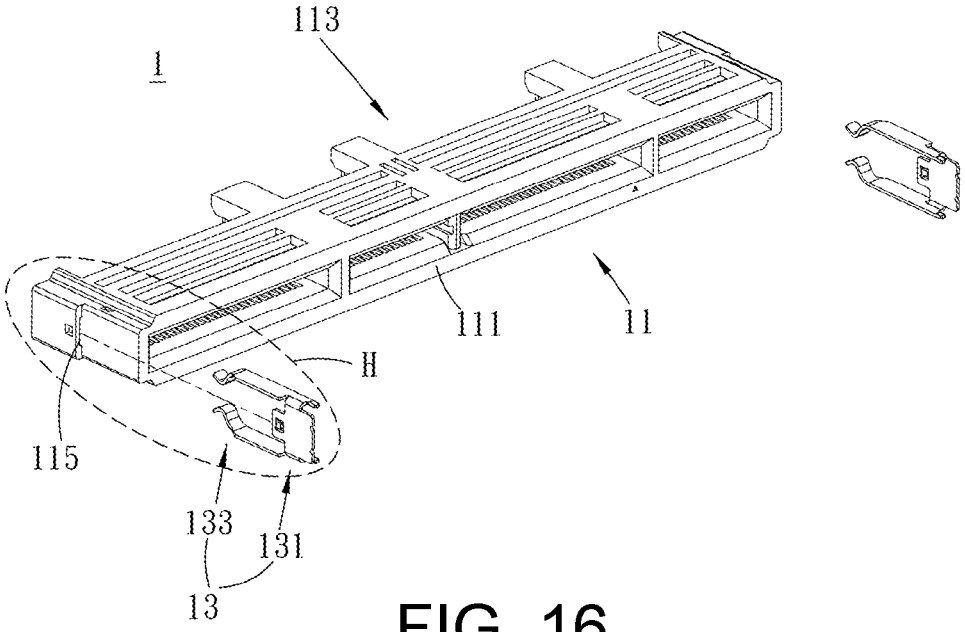
FIG. 16 is an exploded view of the electrical connector of the fourth embodiment of the present disclosure.
Figure 17:
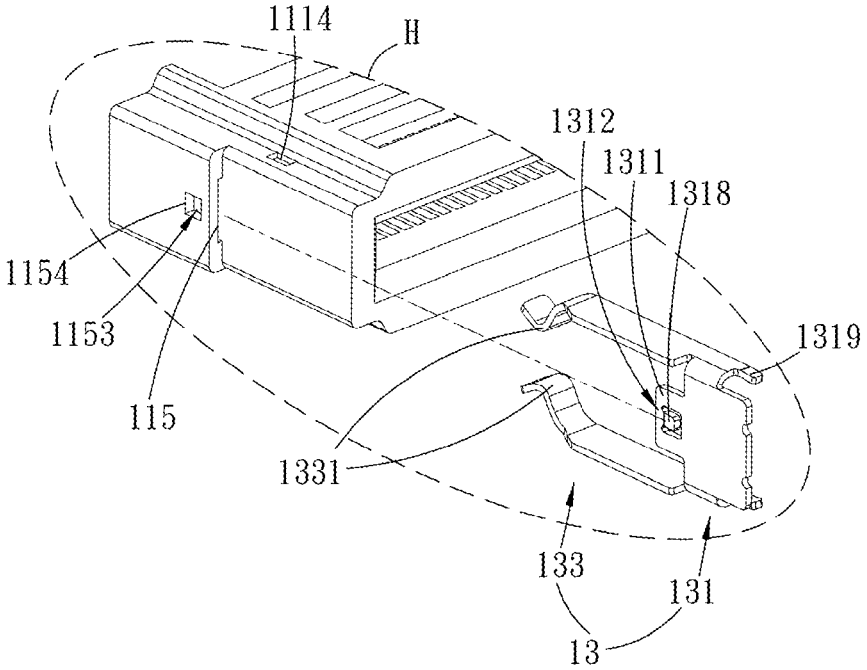
FIG. 17 is an enlarged view of area H of FIG. 16.

FIG. 14 is a perspective view of an electrical connector of the fourth embodiment of the present disclosure. FIG. 15 is an enlarged cross-sectional view along line D-D' of FIG. 14. FIG. 16 is an exploded view of the electrical connector of the fourth embodiment of the present disclosure. FIG. 17 is an enlarged view of area H of FIG. 16. As shown in the figures, the difference between this embodiment and the first embodiment lies in the configuration of the securing member 13 and the way the securing member 13 connected to the securing groove 115. In this embodiment, the outer surface 1312 of the securing bump 1311 comprises an elastic bump 1318. An opening 1153 provided in the securing groove 115 corresponds to the elastic bump 1318. The elastic bump 1318 is secured in the opening 1153.

In this embodiment, when securing bump 1311 enters the securing groove 115, the elastic bump 1318 of the securing bump 1311 would be compressed by the inner wall of the securing groove 115 to be in a compressed state. Then the securing bump 1311 moves into the securing groove 115. When the elastic bump 1318 of the securing bump 1311 moves to the opening 1153 in the securing groove 115, the elastic bump 1318 would be no longer compressed by the inner wall of the groove, then the elastic bump 1318 is restored to the initial state as it is secured in the opening 1153 of the securing groove 115. Finally, the securing bump 1311 is secured in the securing groove 115.

Besides, in this embodiment, the fixing member 13 can also be disassembled and detached from the connector 11. The opening 1153 penetrates the securing groove 115. An orifice 1154 of the opening 1153 is provided on the outside of the securing groove 115. That is, the orifice 1154 is connected to the inside of the securing groove 115. The orifice 1154 of the opening 1153 at the outside of the securing groove 115 compresses the elastic bump 1318. When the elastic bump 1318 is compressed, it would no longer be secured in the opening 1153 to be released from being secured in the opening 1153. Thus, the securing bump 1311 of the securing member 13 can be detached from the securing groove 115.

The clamping part 133 of the securing member 13 clamps and secures the circuit board 15 in the foregoing embodiments. The clamping part 133 and the circuit board 15 can be further secured by riveting, soldering, or screwing. In this way, the securing between the clamping part 133 and the circuit board 15 can be strengthened.

Figure 18:
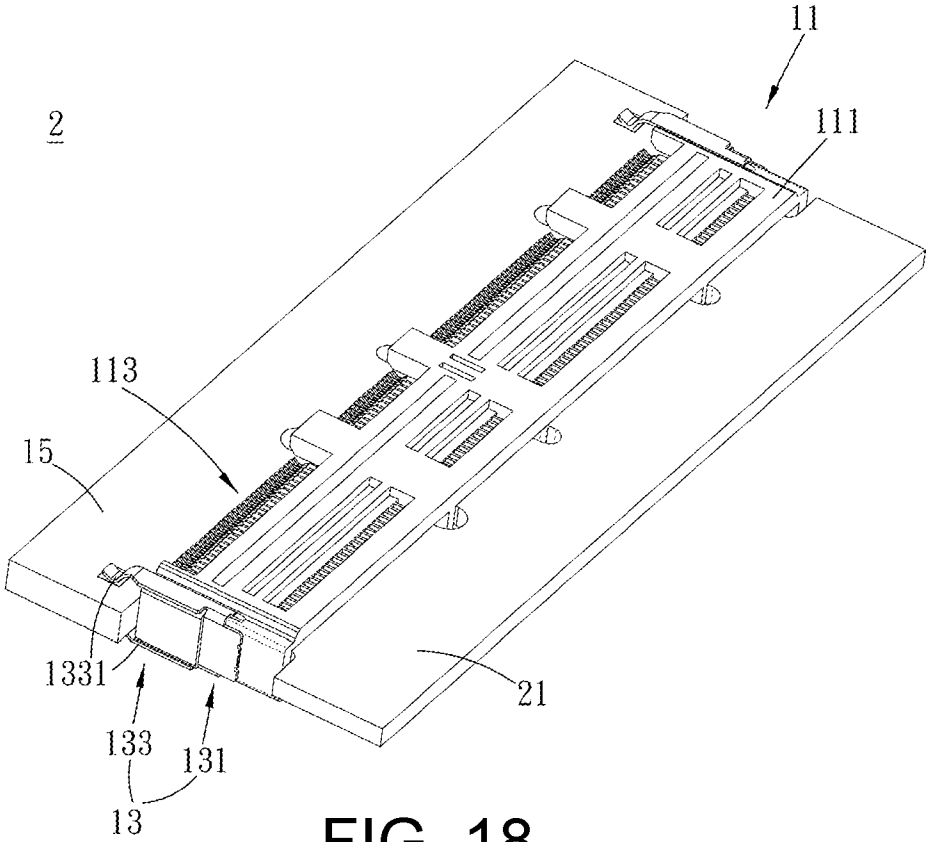
FIG. 18 is a perspective view of the assembling of the electrical connector of the present disclosure.
Figure 19:
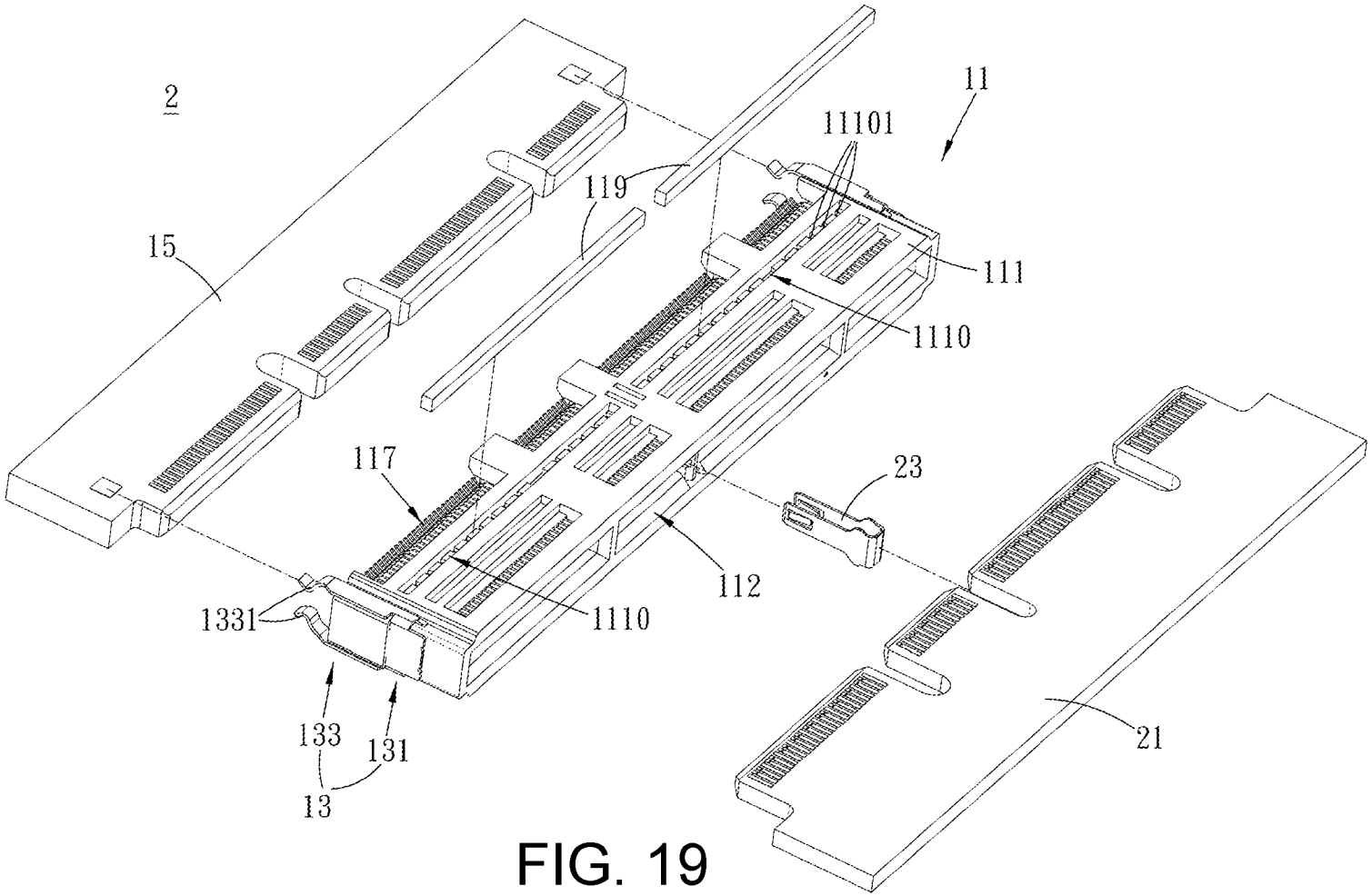
FIG. 19 is an exploded view of the assembling of the electrical connector of the present disclosure.

FIG. 18 and FIG. 19 are perspective view and exploded view of the assembling of the electrical connector of the present disclosure. As shown in the figures, in this embodiment, the connector 11 comprises a terminal 117 and a conductive member 119. The terminal 117 is disposed in the body 111 and is disposed at the connecting terminal port 113. The body 111 comprises a groove 1110 corresponding to the terminal 117. The conductive member 119 is disposed in the groove 1110. The conductive member 119 corresponds to the terminal 117. The conductive member 119 is made of plastic. The bottom of the groove 1110 is provided with a plurality of inner grooves 11101. The terminal 117 comprises a plurality of ground terminals and a plurality of signal terminals. The plurality of inner grooves 11101 respectively correspond to the plurality of ground terminals and the plurality of signal terminals. The plurality of inner grooves 11101 respectively correspond to the plurality of ground terminals, so that the conductive member 119 can be electrically connected with the plurality of ground terminals, forming a shielding circulation.

This embodiment provides an electrical connector assembly 2 comprising an electrical connector 1 and a mating circuit board 21. The electrical connector 1 further comprises a connecting port 112 disposed at one side of the body 111 away from the connecting terminal port 113. The mating circuit board 21 is plugged in the connecting port 112. The electrical connector assembly 2 further comprises a guiding member 23. The guiding member 23 is assembled on the body 111 and is disposed on the periphery of the connecting port 112. The mating circuit board 21 is disposed at the connecting port 112 along the guiding member 23. The guiding member 23 is provided with a smooth curved surface. Thus, through the guiding member 23, the mating circuit board 21 can be easily inserted into the connecting port 112 of the electrical connector 1.

In summary, embodiments of the present disclosure provide an electrical connector and an electrical connector assembly. The securing member can be assembled according to the shape and structural configuration of the body of the connector through a component of the securing part of the securing member corresponding to two sides of the body of the connector to minimize the space that the securing member occupies thereby to reduce the overall size of the electrical connector, which improves the structural designing and assembly process of the electrical connector.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

a connector comprising a body and a connecting terminal port, the connecting terminal port being disposed at one side of the body; and a securing member comprising a securing part and a clamping part, the securing part assembled on the body being disposed at one side of the connecting terminal port, the clamping direction of the clamping part being the same as the opening direction of the connecting terminal port, wherein the securing part comprises a securing bump, a side surface of the body comprises a securing groove, and the securing bump is embedded in the securing groove, wherein the securing bump extends toward the connecting terminal port, and wherein the clamping part comprises two clamping feet oppositely disposed, between which the securing bump is disposed.

2. The electrical connector according to claim 1, wherein the number of the securing parts is two; the two securing parts are assembled on the body and are disposed on two sides of the connecting terminal port.

3. The electrical connector according to claim 1, wherein the securing bump comprises an outer surface, an inner surface, and two side surfaces; the inner surface is close to the connector; the outer surface is opposite to the inner surface; the two side surfaces are connected with the outer surface and the inner surface; the inner surface or the outer surface of the securing bump comprises a bump; the bump abuts against an inner wall of the securing groove.

4. The electrical connector according to claim 1, wherein the securing part further comprises two stopping bumps disposed above and below the securing part, respectively; the connector further comprises two stopping recesses disposed on an upper surface and a lower surface at one side of the body, respectively; the two stopping bumps are embedded in the two stopping recesses.

5. The electrical connector according to claim 1, wherein the two clamping feet extendingly correspond to the upper and lower sides of the connecting terminal port, respectively.

6. The electrical connector according to claim 1 further comprising a circuit board electrically connected with the connecting terminal port; the clamping part of the securing member clamps and secures the circuit board.

7. The electrical connector according to claim 1, wherein the securing bump comprises an outer surface, an inner surface, and two side surfaces; the inner surface is close to the connector; the outer surface is opposite to the inner surface; the two side surfaces are connected with the outer surface and the inner surface; the outer surface of the securing bump comprises an elastic bump; an opening provided in the securing groove corresponds to the elastic bump; the elastic bump is secured in the opening.

8. The electrical connector according to claim 7, wherein the opening penetrates the securing groove; wherein the elastic bump is pressed into an orifice of the opening from the outside of the securing groove to release the elastic bump from the opening so that the securing bump can be detached from the securing groove.

9. The electrical connector according to claim 1, wherein the connector comprises a terminal and a conductive member; the terminal is disposed in the body and is disposed at the connecting terminal port; the body comprises a groove corresponding to the terminal; the conductive member is disposed in the groove; the conductive member corresponds to the terminal.

10. The electrical connector according to claim 9, wherein the bottom of the groove is provided with a plurality of inner grooves; the terminal comprises a plurality of ground terminals and a plurality of signal terminals; the plurality of inner grooves respectively correspond to the plurality of ground terminals.

11. An electrical connector assembly, comprising:

the electrical connector according to claim 1, the electrical connector further comprising a connecting port disposed at one side of the body away from the connecting terminal port; and a mating circuit board plugged in the connecting port.

12. The electrical connector assembly according to claim 11 further comprising a guiding member; the guiding member being assembled on the body and being disposed on the periphery of the connecting port; the mating circuit board being disposed at the connecting port along the guiding member.

13. An electrical connector, comprising:

a connector comprising a body and a connecting terminal port, the connecting terminal port being disposed at one side of the body; and a securing member comprising a securing part and a clamping part, the securing part assembled on the body being disposed at one side of the connecting terminal port, the clamping direction of the clamping part being the same as the opening direction of the connecting terminal port, wherein the securing part comprises a securing bump; a side surface of the body comprises a securing groove; the securing bump is embedded in the securing groove, and wherein the securing bump comprises an outer surface, an inner surface, and two side surfaces; the inner surface is close to the connector; the outer surface is opposite to the inner surface; the two side surfaces are connected with the outer surface and the inner surface; the two side surfaces of the securing bump respectively comprises an abutting block; the abutting blocks abut against two inner sidewalls of the securing groove.

14. An electrical connector, comprising:

a connector comprising a body and a connecting terminal port, the connecting terminal port being disposed at one side of the body; and a securing member comprising a securing part and a clamping part, the securing part assembled on the body being disposed at one side of the connecting terminal port, the clamping direction of the clamping part being the same as the opening direction of the connecting terminal port, wherein the securing part comprises a securing bump; a side surface of the body comprises a securing groove; the securing bump is embedded in the securing groove, and wherein the securing bump comprises an outer surface, an inner surface, and two side surfaces; the inner surface is close to the connector; the outer surface is opposite to the inner surface; the two side surfaces are connected with the outer surface and the inner surface; the two side surfaces of the securing bump respectively comprises an elastic member; a through hole provided in the securing groove corresponds to the elastic member; the elastic member is secured in the through hole.

15. The electrical connector according to claim 14, wherein the through hole penetrates the securing groove; wherein the elastic member is pressed into an orifice of the through hole from the outside of the securing groove to release the elastic member from the through hole so that the securing bump can be detached from the securing groove.

* * * * *